United States Patent [19]

Zepf

[11] Patent Number: 4,934,616

[45] Date of Patent: Jun. 19, 1990

[54] CRUSHING TONGS FOR CLEARING BUILDINGS, PARTICULARLY WALLS MADE FROM REINFORCED CONCRETE

[76] Inventor: Hans-Rudolf Zepf, Glärnischstrasse 15, 8803 Rüschlikon, Switzerland

[21] Appl. No.: 352,831

[22] Filed: May 16, 1989

[30] Foreign Application Priority Data

Jun. 15, 1988 [CH] Switzerland ..... 2307/88

[51] Int. Cl.[5] ..... B02C 1/06

[52] U.S. Cl. ..... 241/266; 241/101.7

[58] Field of Search ..... 241/101.7, 266, 262, 241/300, 298, 291; 299/70, 22

[56] References Cited

U.S. PATENT DOCUMENTS 4,512,524 4/1985 Shigemizu ..... 241/101.7

4,838,493 6/1989 Labounty ..... 241/101.7

FOREIGN PATENT DOCUMENTS

WO8803213 5/1988 PCT Int'l Appl. ..... 241/101.7

*Primary Examiner*—Mark Rosenbaum

*Attorney, Agent, or Firm*—Walter C. Farley

[57] ABSTRACT

The breaking tongs with a tong body (7) for receiving two tong parts (1, 1'), each pivotable about its own rotation center (2, 2'), and spaced from the rotation center the tongs are subdivided into a tong lever (3, 3') for the force action and a cutting lever (4, 4') for exerting the breaking force. The tong protuberances (12, 61, 63) are detachably mounted on the cutting levers. In the vicinity of the tong cutting edge (4, 4') separating blades (6, 6') can be provided for cutting reinforcements. The detachable tong protuberances (61, 63) can be detachably fixed in a protuberance bed (60), which is detachably arranged or shaped on to the cutting lever (4, 4'). A plurality of tong protuberances can form a working profile, which differs as regards the breaking action from another working profile formed from the same or a different number of tong protuberances.

5 Claims, 5 Drawing Sheets

FIG. 2
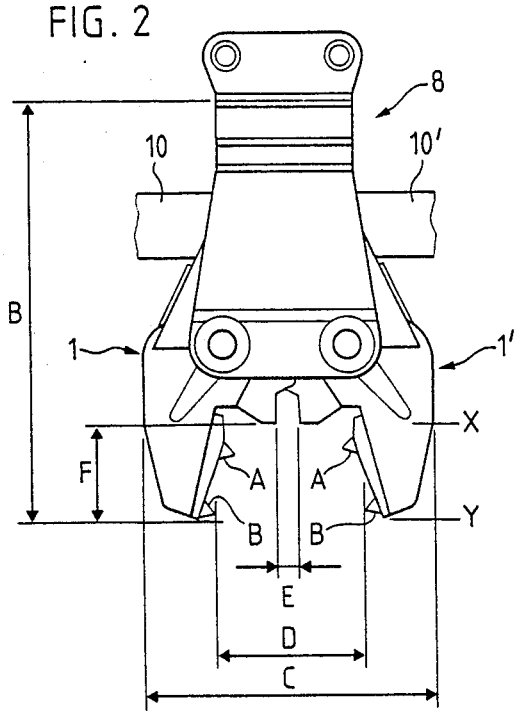
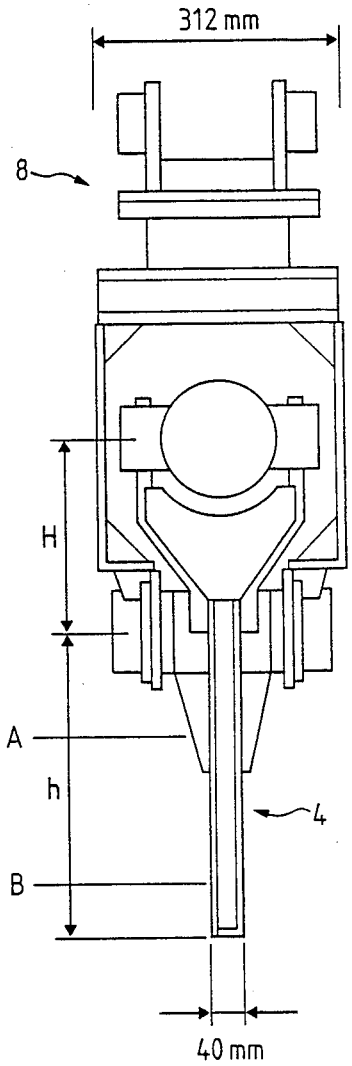
FIG. 4
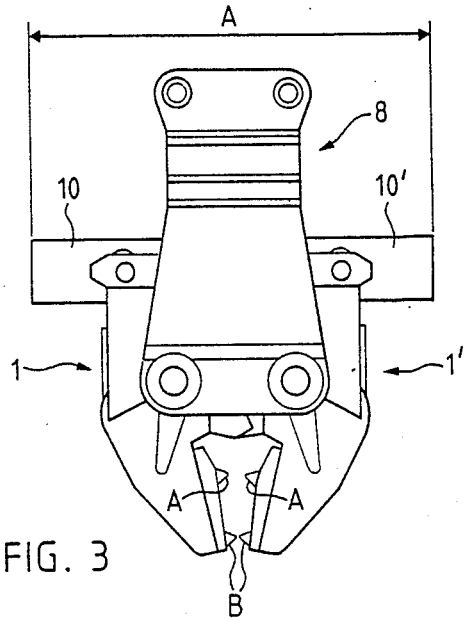
FIG. 3

CRUSHING TONGS FOR CLEARING BUILDINGS, PARTICULARLY WALLS MADE FROM REINFORCED CONCRETE

The invention is in the field of construction machinery and relates to crushing tongs or jaws carried by a construction machine for clearing buildings, particularly reinforced concrete structures.

BACKGROUND OF THE INVENTION

The breaking up of masonry, particularly that constituted by reinforced concrete, causes problems due to the amount of noise and time involved. Whereas in the case of unreinforced masonry the demolition or knocking down and possibly also blasting can be carried out with different suitable aids, the possibilities are drastically reduced in the case of reinforced concrete masonry. Thus, all possible means are used for attempting to break up such structures, such as drills, hammers, tongs, jaws and other destruction means. However, this involves a great deal of noise and only has limited effectiveness.

As is now realized, concrete buildings were incorrectly designed as structures to last for centuries. Particularly in conjunction with their reinforcement, namely a stress-absorbing steel latticed girder construction, problems of durability (life) occur and consequently there are problems in breaking up and clearing such structures. The earliest experience obtained in this connection involved the clearing of the bunkers which had become useless after World War II. These tough structures could only be removed at the time manually using pneumatic hammers and blowpipes and the same still applies with the exception of a certain amount of manual work which is now carried out by machines. Reinforced concrete is difficult to demolish, whilst involving much noise and taking much time.

Concrete tongs or jaws would appear to be the most advantageous solution and they cut or crack the concrete. These hydraulically driven tongs are fast and quiet compared with the pneumatic hammers previously used. However, the equipment expenditure is considerable. Concrete tongs only operate in an optimum manner in a relatively narrow working field, so that for different wall thicknesses tongs with different "bite thicknesses" are used.

It is known that concrete masonry is relatively pressure-sensitive and under pressure a concrete layer tends to crack. This is utilized by the concrete tongs, which exert a wedge action on the concrete surface. However, extremely high breaking or crushing forces have to be expended. They represent 40 to 120 tonnes and over and this force must act on the forked levers, in order to be able to in this way break the concrete.

Thus, tongs are generally made which have a shape not dissimilar to lobster claws and said tongs normally have two tips per tong part. Such tongs press on the concrete with the indicated force in punctiform manner at several points (as in the case of a bit), and the points or tips form cracks through the concrete. This makes it possible to portionwise break away masonry. As soon as the cracking action has detached a concrete fragment from the bond, it still hangs on the reinforcement passing through the masonry and which must be separated in a further operating step. Either iron shears are used for this purpose, or blowpipes have to be used in order to separate the steel strands.

Although this appears to be very plausible, it is problematical to carry out. Firstly enormous forces are required to make such powerful bites. For a biting or breaking force of 50 tonnes between the tong pairs, it is necessary to have operating pressures up to 320 bar, which means that a pressure converter must be used, because almost 80% of shovels or excavators (i.e. the construction machine guiding and operating the breaking tongs) have a normal operating pressure of only 150 to 200 bar. Everything must be mobile and in particular the bite frequency must not be too small. To operate in a cost effective manner a large number of biting processes is necessary, together with a long life of the hydraulics and tong components. This is in turn a problem with regards to the machines and materials. Hydraulic cylinders for such high operating pressures are fault-prone and demolition work exposes them to a severe environment. The tongs can generally only meet these requirements, because they are relatively blunt and rough. However, the blunter the tong tips, the higher must be the tong force in order to achieve a satisfactory breaking action.

SUMMARY OF THE INVENTION

An object of the present invention is to provide breaking tongs having a greater biting or breaking range. Another object of the invention for the breaking tongs to have a comparable biting or breaking capacity to breaking tongs operated with pressure converters for a much lower operating pressure. Thus, the tongs can also be used for mini-excavators and midi-excavators with a dead weight up to 7 t. Another object of the invention is to be able to use the same apparatus for cutting through the reinforcement in the concrete.

BRIEF DESCRIPTION OF THE DRAWINGS

An embodiment of the invention is described in greater detail hereinafter relative to the drawings, wherein:

FIG. 2 is a side elevation of the concrete tongs according to FIG. 1 in the assembled, open state.

FIG. 3 is a side elevation of the concrete tongs according to FIG. 1 in the assembled, closed state.

FIG. 4 is a side front elevation of the concrete tongs according to FIG. 1 seen from the narrow side.

DETAILED DESCRIPTION OF THE PREFERRED EMBODIMENTS

Figure 1:
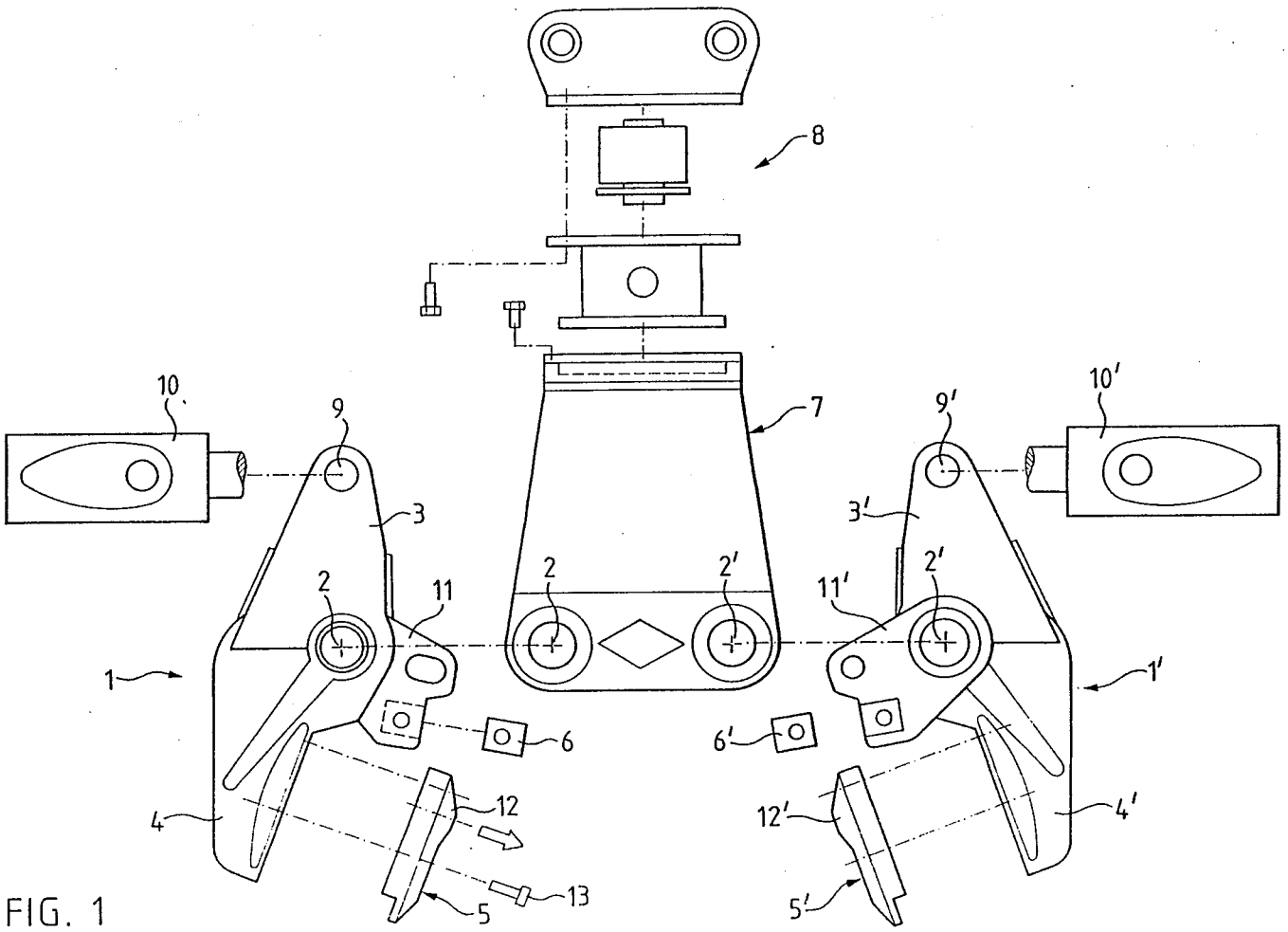
FIG. 1 is a partially exploded side elevation of concrete tongs according to the invention in the open state having a dead weight of only 250 kg and minimum H×W×D dimensions equal to 920×950×312 mm and with an opening of 450 mm and for which the indicated breaking forces apply.

The tongs shown in FIG. 1 comprises the following essential components. The tong parts 1, 1', exercise the tong function through acting against one another. The tong parts 1, 1' pivot about two rotation axes 2, 2', which are at a given distance from one another and this distance will be discussed hereinafter. Through the here roughly centrally located rotation axis the tong parts are subdivided into two, namely the tong levers 3, 3' and the cutting levers 4, 4'. The tong parts are pivotably mounted on a tong body 7. Hydraulic operating pistons 10, 10' operate the two tong parts, the action point of the force on the tong levers 3, 3' being located at the outer ends 9, 9' of said levers. The force actuating component is a double-acting, hydraulic piston 10, 10', whose operation will be described hereinafter.

Outside the rotation axes 2, 2' in the direction of the cutting levers 4, 4', are tong projections 11, 11', each of which in itself forms a type of tong is arranged on the tong parts 1, 1'. This tong projection 11, 11' in each case carries a cutting edge 6, 6' for cutting reinforcements, particularly reinforcing irons. For breaking concrete, each cutting lever 4, 4' of tong parts 1, 1' carries a tong cutting edge 5, 5', each of which has at least two tong protuberances, 12, 12', which are interchangeable in a special embodiment. The tong cutting edge 5 is detachably fixed by e.g. screws 13 to tong part 1.

FIGS. 2 and 3 show the concrete tongs in the open and closed assembled state. Particular reference is made to the tong protuberances 12, 12', referred to here as the rear protuberance A and the front protuberance B. The rear protuberances A bring about a so-called prebite, with which the breaking point is indicated and thereby brings about breakage. The front protuberances bring about a so-called afterbite, with which the break is converted into reality. The distance between the protuberances A and B designates the lever length on which the breaking force would decrease if the protuberances were of the same size. However, for this reason the protuberances have a differing height, so that the inner protuberance A with the smaller lever length and the greater force action acts earlier and consequently exerts the initial breaking force, whereas the outer protuberance B with the greater lever length and the smaller force action applies its force somewhat later to the substrate to be cracked and therefore takes over the final breaking force. Thus, the breaking action of the tong parts for a given operating force can be adjusted to different breaking or wall thicknesses through the spacing between the two protuberances and the height of the protuberances corresponding to the opening width.

In order to realize this adjustment possibility, the breaking protuberances are detachable and interchangeable. According to the embodiment of FIG. 1, different tong cutting edges 5, 5' are provided with correspondingly shaped-on or mounted tong protuberances, 12 12' in part 4, 4' and are fixed to the cutting levers with fastening means, such as, e.g., by a screw 13.

In another embodiment the protuberances are detachably inserted in the cutting levers 4, 4' or in an intermediate carrier, in much the same way as the tong cutting edges 5, 5'. The tong protuberances, with cutting edge and root, are inserted in a tapering opening and e.g. secured by a crosspin. As the tong protuberances exert their breaking action under pressure, they do not have to be secured against high tensile forces. It is therefore adequate to insert the crosspin through a depression in the protuberance root, so that it is merely jammed in. Further reference will be made thereto in connection with FIG. 6.

Figure 8:
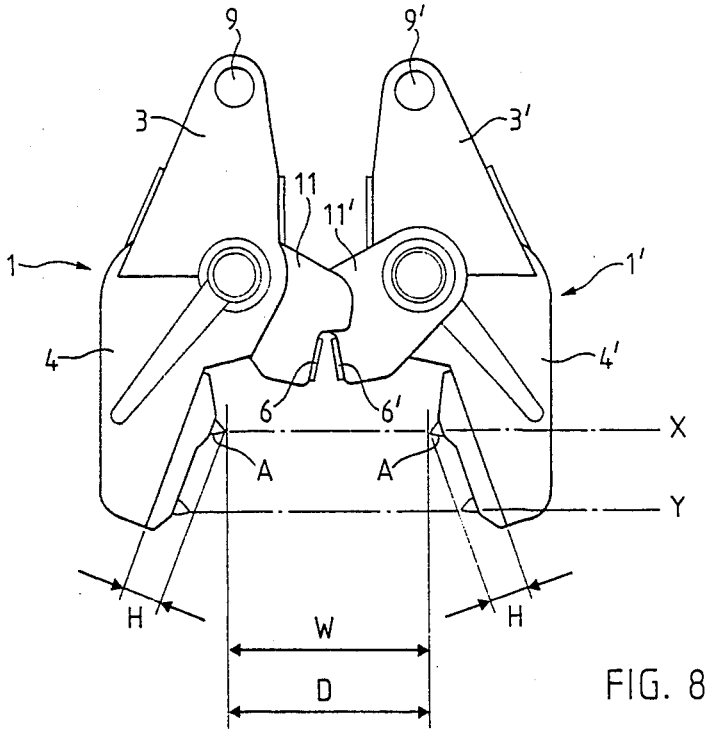
FIG. 8 is a side elevation of tongs according to the invention relating the dimensions of the bite height to the wall thickness and the resulting working time.

This embodiment has considerably advantages, because the tong protuberances, which are made from a hardened material, can be prefabricated. In addition, the tong protuberances can be standardized. Therefore all the interchangeable tong protuberances have the same size and the same root configuration. The protuberance cutting edge is built up with different heights on such a standard root. In this way each tong protuberance can be inserted at point A or B, as a function of the desired bite profile for the prebite and the postbite and optionally also for an intermediate bite, if more than two tong protuberances are to be arranged on the cutting edge lever 4, 4'. It is readily apparent that in this way random bite characteristics can be produced. Another advantage (cf. FIG. 8) is that with the different lengths of the tong protuberances forming the height H, the maximum opening extent of the tongs is determined. In the present example with a standard use, H is 300 mm at bite point A/A (FIGS. 2 and 3) in the X-axis. Within these axes X and Y in the case of completely open tongs, the maximum path and therefore wall thickness is defined. In order to obtain a small "working time" with maximum force, it is necessary to fix the correct opening amount as can be seen in the force diagram of FIG. 5. If a wall with a thickness of e.g. 250 mm has to be broken, said opening and "working time" will be of an optimum nature, whereas when the thickness is only 150 mm it would be necessary to increase the protuberance height, so as to keep the working time just as small and this has an effect on the complete working time. This occurs if the breaking tongs have to perform a certain closing distance virtually in the open air. A time rationalization of the operation is made possible through the adaptation of the working profile, in such a way that apart from the modified breaking action, the working time is also minimized.

FIG. 4 shows the concrete tongs from the side clearly revealing the surprisingly narrow width of cutting levers 4. In the represented embodiment the cutting lever thickness if approximately 40 mm, whilst the total tong thickness is over 30 cm (which corresponds to model T-3 of the breaking tong series). It is possible to see the lever proportions H:h or H:A for the inner tong protuberance and H:B for the outer tong protuberance. It is clear that it is also possible to have intermediate tong protuberances, which within the proportion H:h exert their corresponding breaking action in conjunction with the preliminary work and/or cooperation with the other tong protuberances.

Reference is also made to the suspension means 8, on which the concrete tongs are mounted so as to rotate about its longitudinal axis. This free rotatability is necessary in order to avoid harmful torsional forces on the hydraulic jib to which the concrete tongs are fixed. Thus, the tongs can be applied to the masonry and closed. Any rotation and tilting of the tongs is prevented by the rotatability of the suspension means.

However, according to the invention, the concrete tongs must also be able to cut through the reinforcing bars cast into the concrete during the same or a following operation and for this purpose on each tong part 1, 1' is provided a tong projection 11, 11' for receiving a separating blade 6, 6'. In the same way as the tong protuberances 12, 12', the separating blades 6, 6' are fixed in a detachable and replaceable manner in the tong projection.

The operation of this separating or cutting mechanism is clearly apparent from FIGS. 2 and 3. If the tongs are completely open, then the separating blades are also open (FIG. 1). If the tongs are slowly closed, then the blades are closed, i.e. the reinforcement is cut through in the case of application of the inner tong protuberance for its breaking action. When the tongs are closed (FIG. 2), the blades are moved completely past one another. In order that the cutting blades 6, 6' cannot strike against the masonry, although made from a hardened material, they are lowered to a certain extent, as can be seen in FIG. 2. The opening width of the separating or cutting mechanism is also adapted to the standard thickness of reinforcing bars, e.g. 40 mm, which should be adequate for all conceivable reinforcements.

Before studying the breaking force diagrams, reference is made to a further advantage of the interchangeability of the tong protuberances and separating blades. The breaking of concrete is based on a wedge action with which the surface layer of the concrete wall is driven apart. New tong protuberances have a better wedge action than blunt ones. In addition, the inner tong protuberances are exposed to a greater force and therefore are subject to more rapid wear than the outer tong protuberances. As now the tong protuberances can be individually replaced and therefore replacement is more cost effective, the breaking capacity can be kept much higher than hitherto for the same costs. There is also the possibility of an optimum protuberance arrangement with respect to the height thereof, which is added to the improvement of the breaking efficiency. This also applies with regards to the separating or cutting blades 6, 6', whose shape and arrangement can be varied for increasing the shearing action.

Figure 5A:
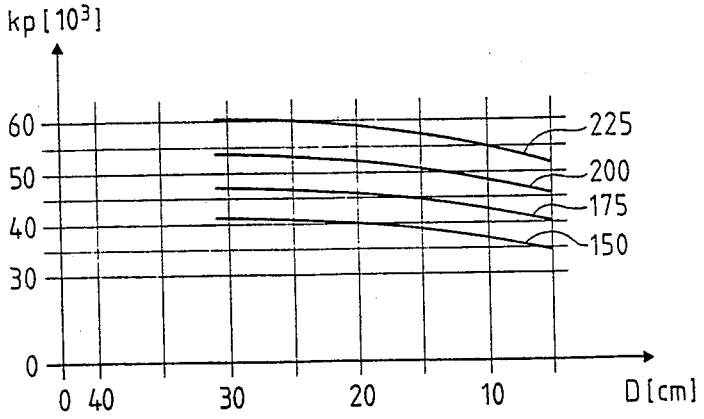
FIGS. 5A, 5B, and 5C are graphs of the breaking or cutting force of the tongs according to FIG. 1 as a function of the wall or steel thickness D, the breaking force being measured at an inner point A and an outer point B in the tong opening and in the cutting device.
Figure 5B:
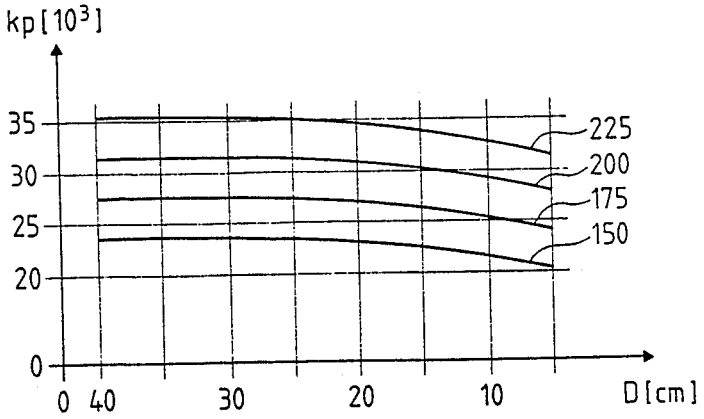
Figure 5C:
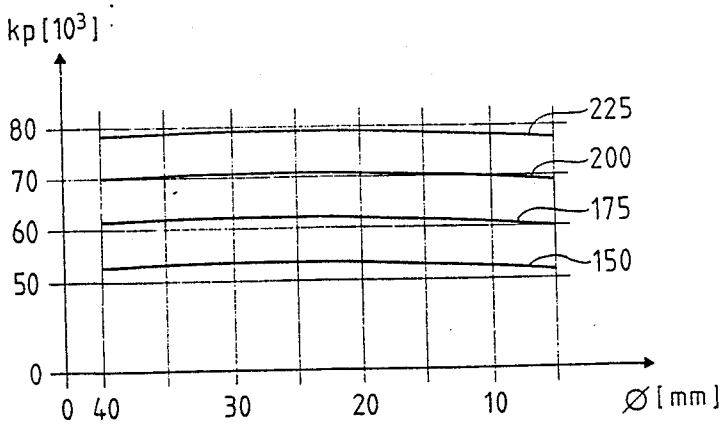

FIGS. 5A, 5B and 5C show breaking or cutting force diagrams as a function of the wall or steel thickness. The force action on the material to be cleared is shown on the inner tong protuberances at point A, on the outer tong protuberances at point B and between the separating blades under different operating pressures, which are 150, 175, 200 and 225 bar. The breaking force is between 35 and 60 tonnes between the inner protuberances and 20 and 36 tonnes between the outer protuberances for 10 and 40 cm thick walls (cf. also captions on FIG. 1) and the cutting force between the blades is between 50 and 80 tonnes for 10 to 40 mm reinforcing rods. The proportions of the tong levers are approximately as follows. The distance from rotation axis 2, 2' of a tong part 1, 1' extends to the force application point in the tong lever 3, 3' and transferred to the cutting levers 4, 4' between the inner and outer tong protuberances in points A and B. Thus, the inner tong protuberances are exposed to a higher breaking pressure than the tong lever force and the outer tong protuberances to a somewhat smaller pressure.

The breaking force diagrams correspond to tongs with a maximum opening of 45 cm. It can be seen that the breaking force starts to decrease between the inner tong protuberances for wall thicknesses somewhat over 25 cm and between the outer protuberances for wall thicknesses somewhat over 20 cm. The reason for this is the tong geometry, which in the case of tongs is dependent on the cutting or tong lever length. Whereas the tong lever length is constant, the cutting lever length varies and in the present case by about 25 cm.

Figure 9:
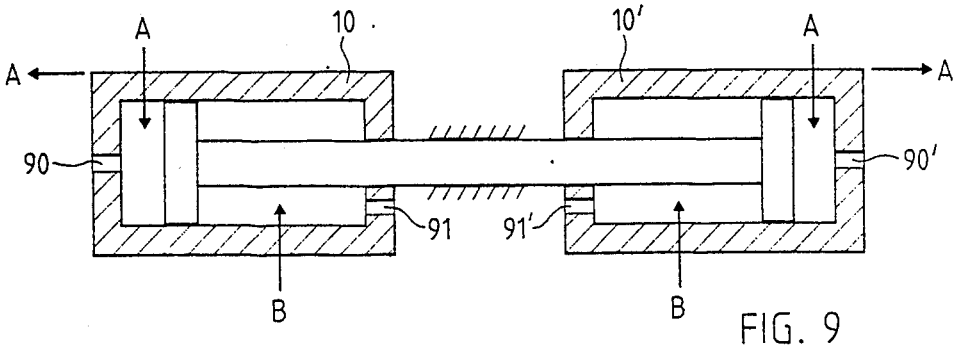
FIG. 9 is a schematic sectional view of a hydraulic drive as used in the breaking tongs according to the invention.

The force on the tong levers 3, 3' is exerted hydraulically by a double acting cylinder, which has an overhung piston and is operated with both piston surfaces, i.e. the hydraulic pressure is applied on one piston side to the outer piston head and on the other side simultaneously to the inner or lower piston head. Thus, with a very short concrete tong construction, through approximately doubling the piston surface in one action direction virtually the force of two hydraulic cylinders is obtained. This makes it unnecessary to have a pressure converter, which must generally be used in order to obtain the necessary breaking force of 30 to 40 tonnes for an operating pressure of approximately 150 bar. The conventional pressure converters have a conversion action roughly of a factor of 2 to 4. FIG. 9 shows such a cylinder. Surfaces A have twice greater surface or pressure for closing the tongs slowly via the hydraulic inlets 90, 90' with the maximum pressure, i.e. high force, so that the action of two cylinders is obtained, whereas surfaces B with twice smaller surface are used for opening the tongs via the hydraulic inlets 91, 91'rapidly and with a lower pressure. The overall effect is slow if much force is used and fast if little force is used, which gives an optimum working cycle.

Figure 6:
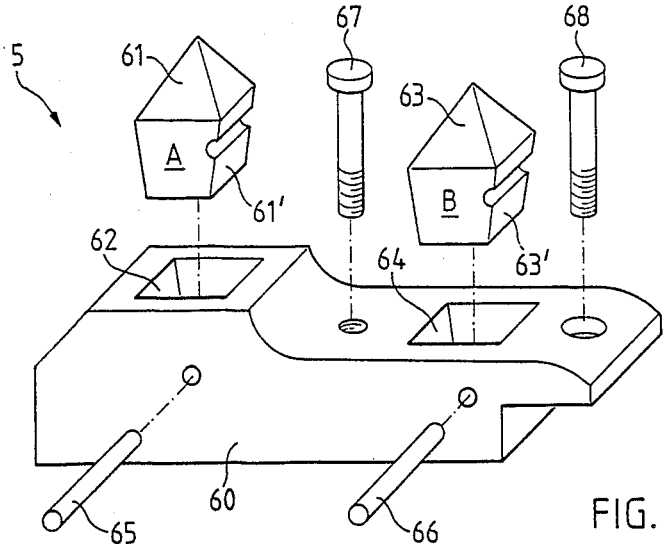
FIG. 6 is a perspective exploded view of an embodiment having interchangeable tong protuberances, which merely have to be inserted and secured in position.

FIG. 6 shows the means with the interchangeable tong protuberances in an embodiment with which the concrete tongs always have the correct "denture" or merely new teeth are inserted. This all constitutes a tong cutting edge 5, as can be seen with shaped-on protuberances in FIG. 1. This cutting edge comprises a protuberance bed 60 with recesses 62, 64 for receiving the sharp protuberances 61, 63. The latter are made from a hardened metal and are the wearing parts which, once blunt, can be replaced. However, the detachability is not only intended to be advantageous in the case of wear, but also to obtain a working profile formed by variable protuberance height and arrangement. Protuberance 61 is the higher protuberance A and protuberance 63 the lower protuberance B and together they form a working profile. Protuberance bed 60 is constructed in such a way that it contributes to the working profile. The protuberance bed could also be constructed without a shoulder and instead use longer and shorter protuberances or embed protuberances of different sizes at varying depths, etc.

As stated hereinbefore, as a function of the tong opening, the working profile leads to a different breaking action, which can be correspondingly utilized. For example, on the basis of empirical knowledge, tables can be used, on the basis of which for a given breaking action the corresponding protuberance beds and the corresponding protuberances can be obtained and chosen in the correct numbers.

The protuberance bed 60 is screwed onto the cutting lever 4 of the concrete tongs and for this purpose screws 67, 68 are shown. The tong protuberances 61, 63 are inserted in recesses 62, 64 in the protuberance bed. In order to ensure the compressive force transfer from the protuberances to the protuberance bed and so as to be able to easily remove the protuberances from their seat again, the protuberances are tapered (slightly downwards) in the seat area 61', 63'. The protuberances are fixed in the protuberance bed by means of crosspins 65, 66. As the tong protuberances are not tensile stressed, this fixing method is adequate.

Figure 7:
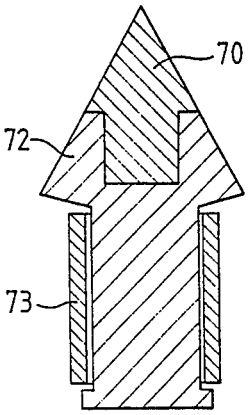
FIG. 7 is a sectional view of an interchangeable tong protuberance, such as can be used in the embodiment according to FIG. 6.

FIG. 7, 7A show an embodiment of a tong protuberance with a cemented carbide tip, which gives very good results. The cemented carbide tips 60 are pressed into a steel bed 62 of the protuberance and held in place by press tension. A clamping sleeve 63 serves as an insert between the protuberance bed and the steel bed for the cemented carbide tips of the complete tong protuberance.

Although in exemplified manner a tong cutting edge with only two protuberances has been discussed, it is pointed out that the cutting edge can have three, four or more protuberances, which has been covered by the term "denture" hereinbefore.

I claim:

1. A breaking tong structure for clearing buildings of reinforced concrete and the like comprising the combination of a tong support body (7);

a pair of tongs (1, 1') pivotally mounted on said support body for pivoting motion about spaced centers of rotation, each said tong comprising a tong lever portion (3, 3') and a cutting lever portion (4, 4');

means for exerting force on said tong lever portions to force said cutting lever portions toward and away from each other;

a tooth support structure for each tong;

means for detachably connecting one said tooth support structure to each cutting lever portion in a position such that said tooth support structures face each other when said cutting lever portions approach each other;

a plurality of teeth detachable mounted on each said tooth support structure thereby forming a plurality of cooperating, individually replaceable force exerting members which can be applied to penetrate a concrete structure to be removed.

2. A tong structure according to claim 1 wherein each said tooth support structure is formed with a profile having portions which protrude a plurality of distances from said cutting lever portion, said teeth being attachable to said different portions to thereby present force exerting members at a plurality of relative spacings.

3. A tong structure according to claim 2 wherein said means for exerting force includes a double-acting hydraulic cylinder.

4. A tong structure according to claim 2 wherein each said tooth includes a base portion and a carbide tip adhesively secured to said base portion.

5. A tong structure according to claim 2 wherein each said support structure holds a tooth closest to said center of rotation so that its distal end is spaced farther from said cutting lever portion than a tooth farthest from said center of rotation.

* * * * *